US006811522B1

(12) United States Patent
McQuinn

(10) Patent No.: US 6,811,522 B1
(45) Date of Patent: Nov. 2, 2004

(54) TOTAL TRUNK TRACTION

(76) Inventor: Andrew James McQuinn, 1712 Amirault Street, Dieppe, NB (CA), E1A 1E5

( * ) Notice: Subject to any disclaimer, the term of this patent is extended or adjusted under 35 U.S.C. 154(b) by 0 days.

(21) Appl. No.: 09/492,379

(22) Filed: Jan. 27, 2000

(30) Foreign Application Priority Data

Feb. 8, 1999 (CA) ..... 2215428

(51) Int. Cl.[7] ..... A63B 26/00

(52) U.S. Cl. ..... 482/143; 482/98; 482/99; 482/92; 482/130; 482/100; 482/102; 482/142; 482/144; 482/148; 602/32; 602/19; 606/242; 128/845

(58) Field of Search ..... 482/142–144, 482/98, 99, 92, 130, 100, 102; 606/242; 602/19, 32; 128/845

(56) References Cited

U.S. PATENT DOCUMENTS 1,164,217 A * 12/1915 Rossello
1,233,496 A * 7/1917 Nicols
1,693,810 A * 12/1928 Daniels et al.
2,228,793 A * 1/1941 Swofford
4,372,551 A * 2/1983 Yurdin ..... 482/57
4,834,365 A * 5/1989 Jones ..... 482/100
4,890,604 A * 1/1990 Nelson ..... 602/32
5,129,881 A * 7/1992 Pope ..... 602/32
5,453,080 A * 9/1995 Mitchum, Jr. ..... 600/38
5,472,307 A * 12/1995 Kadlec et al. ..... 414/678
5,499,962 A * 3/1996 Jones ..... 482/137
5,542,746 A * 8/1996 Bujaryn ..... 297/423.12
5,575,743 A * 11/1996 Jones et al. ..... 482/97
5,616,107 A * 4/1997 Simonson ..... 482/97
5,709,633 A * 1/1998 Sokol ..... 482/62
5,782,869 A * 7/1998 Berdut ..... 606/242
5,800,321 A * 9/1998 Webber ..... 482/103
5,860,899 A * 1/1999 Rassman ..... 482/142
5,885,197 A * 3/1999 Barton ..... 482/144
5,964,682 A * 10/1999 Sokol ..... 482/62
5,967,610 A * 10/1999 Lin ..... 297/340
5,967,956 A * 10/1999 Teeter ..... 482/144
5,974,902 A * 11/1999 Scofield ..... 73/865.6

* cited by examiner

*Primary Examiner*—Nicholas D. Lucchesi
*Assistant Examiner*—L Amerson

(57) ABSTRACT

An exercise with traction device comprising a frame holding a seat above the floor that has a resistance loaded backrest for the purpose of rehabilitating atrophied spinal support muscle through progressive resistance exercise while the spine is under pain alleviating traction. The backrest is resistance loaded for both traction, and extension resistance or flexion resistance. This makes needed exercise for those who are hindered from such therapy by spinal compressive related pain. The exercise resistance is transmitted to the patient via a horizontal axis backrest, and can be weighted either positively for back resistance, or negatively for abdominal resistance, at the same time traction is applied from the backrest suspension system applying resistance to the user attached to it in the direction that decompresses the spine.

1 Claim, 8 Drawing Sheets

TOTAL TRUNK TRACTION

BACKGROUND OF THE INVENTION

1. Field of the Invention

This invention relates to physiotherapy, chiropractic and sports medicine exercise and rehabilitation equipment used in the treatment of back pain, that either attempt to strengthen spinal supportive muscles, or alleviate pain aggravated by gravitational compression of the human spine. The only therapies presently available for this common condition are the use of various exercise equipment for strengthening trunk muscles, or equipment for easing back pain, namely traction equipment, such as inversion apparatuses that invert the human body so that a reverse gravity traction can unload the spinal discs while the patient remains inverted, or equipment that traction's the spine by mechanical means. Though this pain relief is often only while under traction, for patients suffering from loss of fluid in the compressed state, temporary pain relief exists after use, as while under traction these leaky discs expand and temporarily re-absorb lost fluid.

2. Description of the Related Art Including Information Disclosed Under 37 CFR 1.97 and 1.98

Although various prior art relates to exercise of the back muscles, or various means of tractioning the spine, the problem of needed, non passive progressive resistance exercise to strengthen spinal support muscles at the same time under pain alleviating traction to make the exercise possible was previously unresolved or not addressed.

BRIEF SUMMARY OF THE INVENTION

This invention is the first ever apparatus that offers a progressive resistance exercise to all the long muscles of the human trunk, while the spine is in traction, and offers a less temporary, longer lived pain relief than traction only methods, by strengthening trunk muscles that support the spine. The erector muscles of the back, abdominal and oblique can be strengthened while under pain alleviating traction, thus improving spinal muscular support, in many cases improving the condition of individuals afflicted by spinal compression pain typically caused by discs that flatten excessively and push against spinal nerves. In some cases using this invention will be an alternative to medical surgery. This progressive resistance exercise traction therapy is made possible by the invention which embodies traction force applied to the backrest to bias the backrest away from the seat, such as applied by coil springs that tension as they elongate. This traction force is transmitted to the user as an upward pull applied to the user's trunk by attaching the user's trunk to the backrest by such means as under the armpit holders that are perpendicular to the backrest. Exercise resistance for back extension is transmitted to the user via the backrest being loaded with resistance on the opposing side of the backrest's horizontal axis shaft that is held between two bearings. This shaft acts as the backrest hinge and transmits weight resistance for back exercise via the back rest rotating the said shaft and rotating a cam at one end of it, correspondingly lifting a weight stack from the floor by a cable attached to said cam, running along cam's circumference. On this cam is an adjustable counterweight to offset the user's upper body mass with respect to the upper body angle and gravitational effects on it. For abdominal and frontal muscle resistance, the said cable is unattached from the cam, disengaging the weight stack on the floor, and the counterbalance is set from neutral balance, to under balance the user's upper body mass, so that the back rest requires abdominal effort by the user to stay, or to return to, the starling position of a 90 degree angle between the upper body and upper legs. The back rest can be pivotally rotated on an axis perpendicular to the backrest's hinge axis by the user's trunk twisting to place emphasis on the oblique muscles during both back and abdominal exercise, or locked in the forward facing position. Additional traction may be applied by gravitational means with the embodiment of a seat that is part of a rearward rotating horizontal axis shaft, held high enough off the floor in bearings between two vertical posts to allow inversion clearance. This shaft rotates the seated user and backrest assembly backward, and when rotated to minus 90 degrees, the seat bottom would then be perpendicular to the floor. If the user is seated at the usual 90 degree start position, their upper body would now be horizontal to the floor. The full inverted position is not reached until the user extends the back the full 90 degrees. If steep inversion is selected, the user is held from falling by an adjustable padded device that engages the person behind the knee, then the lower leg is bent at near right angles, and the ankles or lower legs are held front and back between another set of adjustable pads. Also, a strap across the uppermost part of the upper legs, near the waist, holds the user to the seat bottom, and holds the pelvis in place during the biomechanics of the rearward exertion.

BRIEF DESCRIPTION OF SEVERAL VIEWS OF THE DRAWINGS

In drawings that illustrate the embodiments of the invention:

FIG. 1 shows the start position as well as the approximate location of the axis in the human trunk (20) in relation to the axis (2) of the backrest, and FIG. 2 shows full extension of the back in that exemplified −30 degree inversion Full disclosure relates to the following CAD drawings:

DETAILED DESCRIPTION OF THE INVENTION

Figure 1:
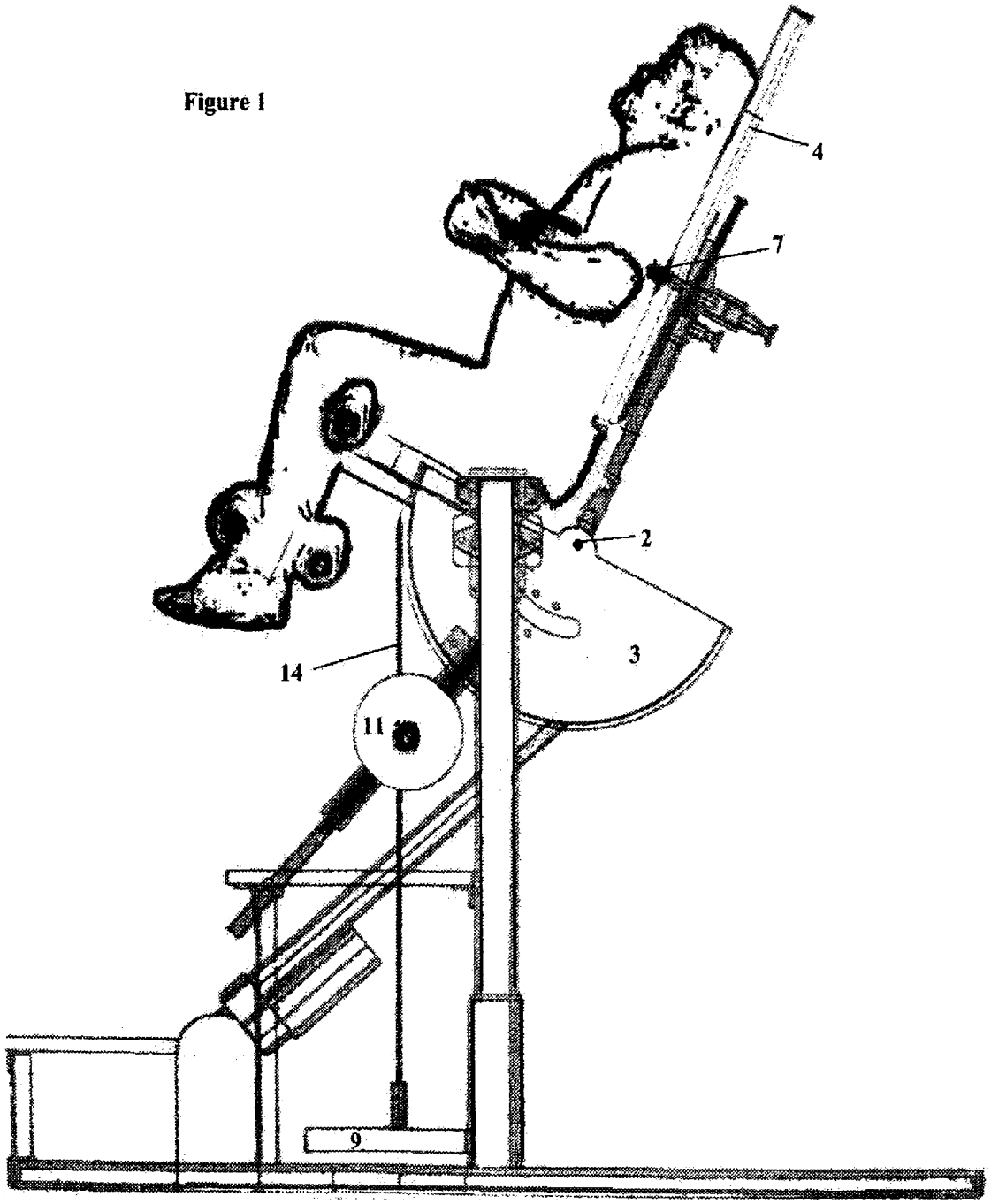
FIGS. 1 and 2 depict a general artist's concept side view of a person seated, illustrating an inversion angle of −30 degrees, one of infinite angles between 0 degrees and −90 degrees of inversion.
Figure 2:
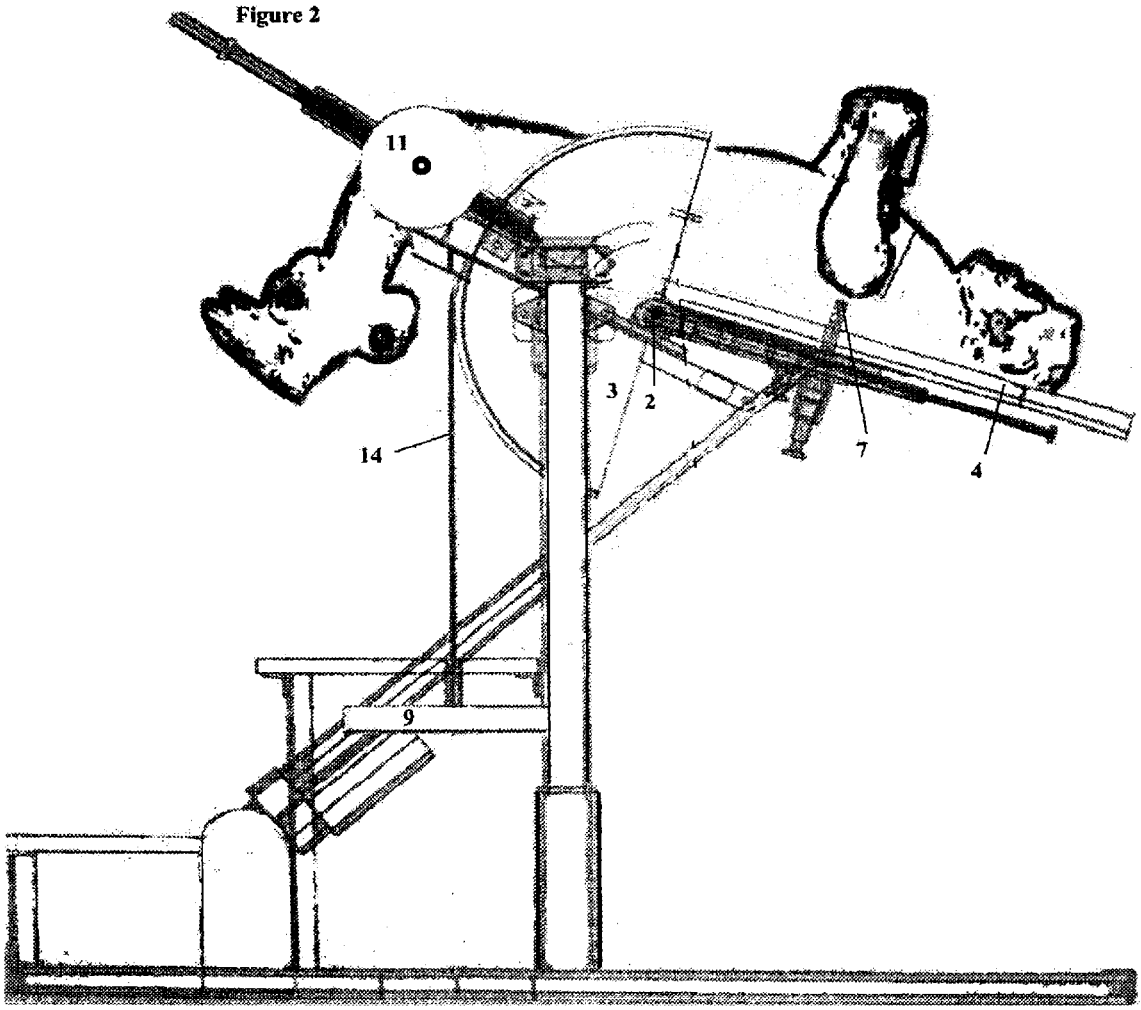
Figure 3:
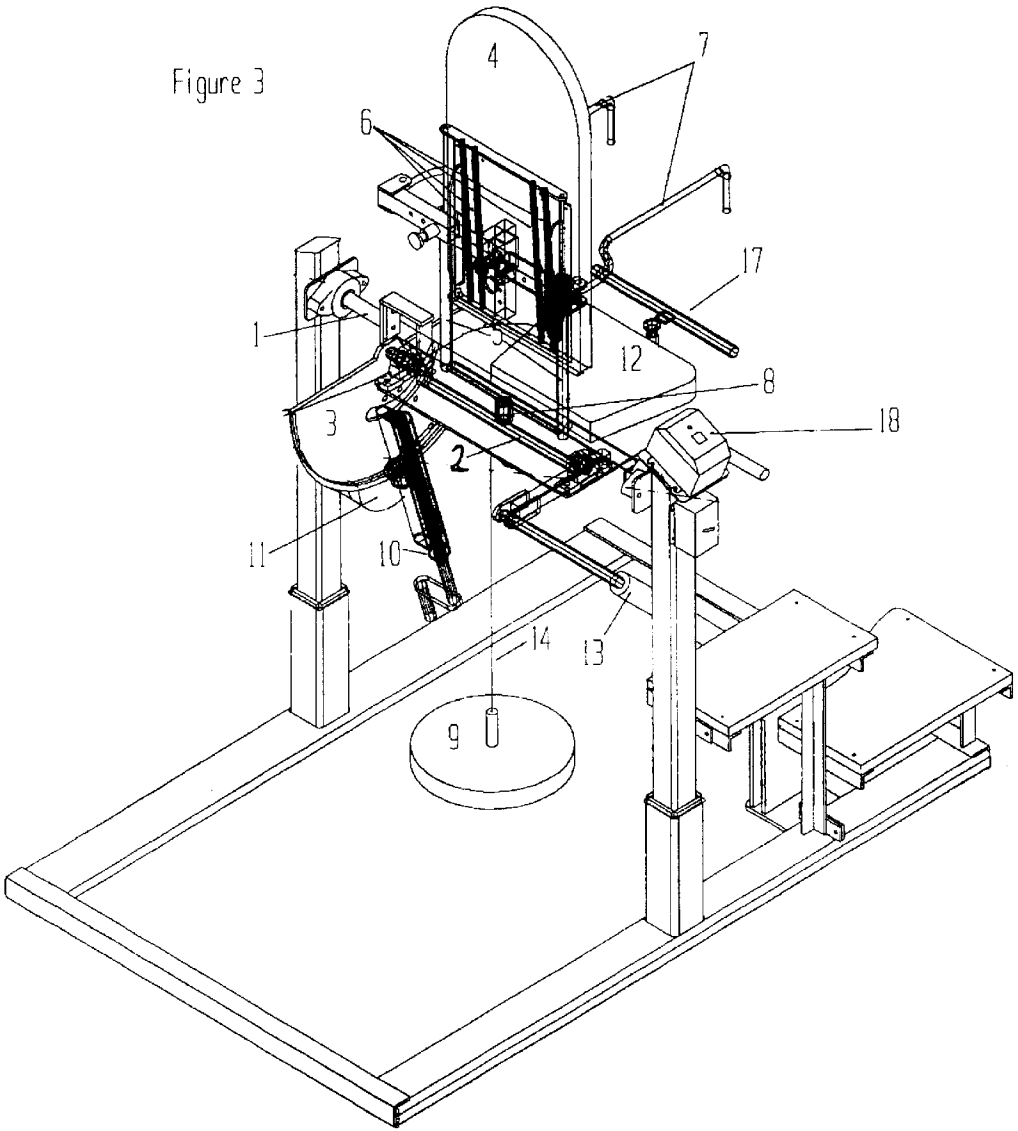
FIG. 3 is a cad drawing of an isometric view, showing all major parts.
Figure 4:
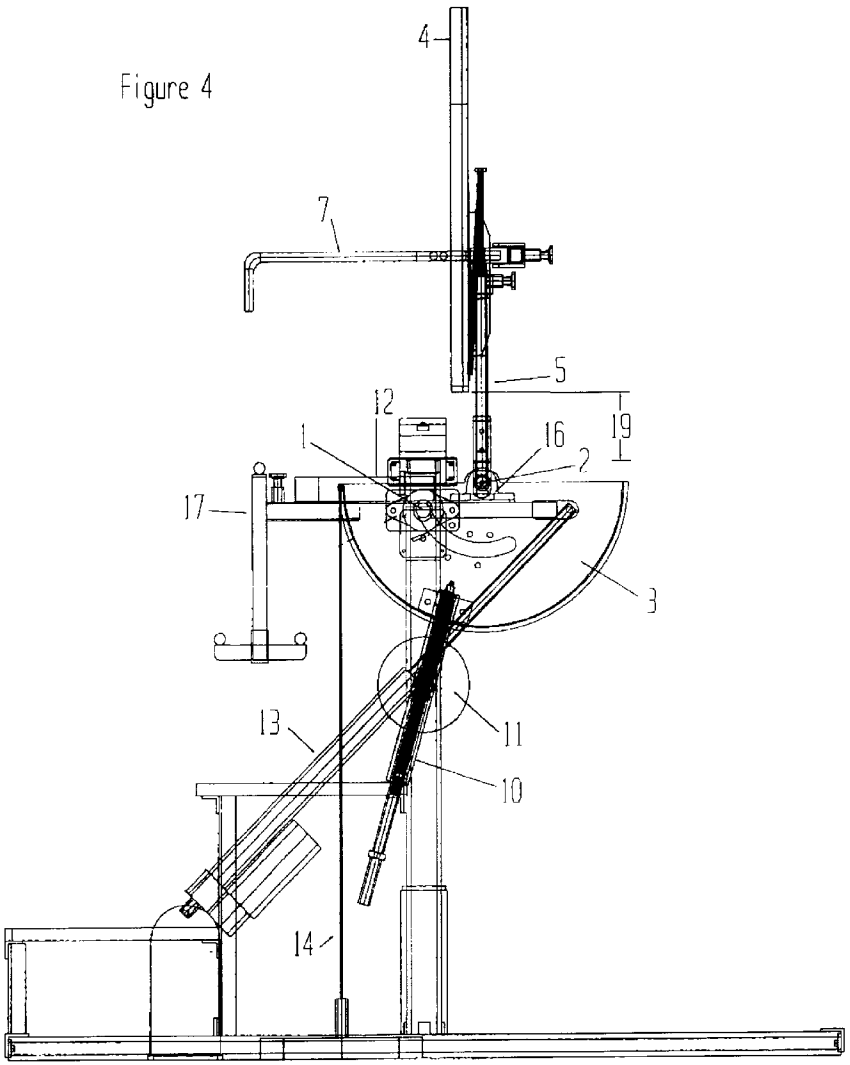
FIG. 4 is a cad drawing of the left side elevation at start position, 0 degrees inversion.
Figure 5:
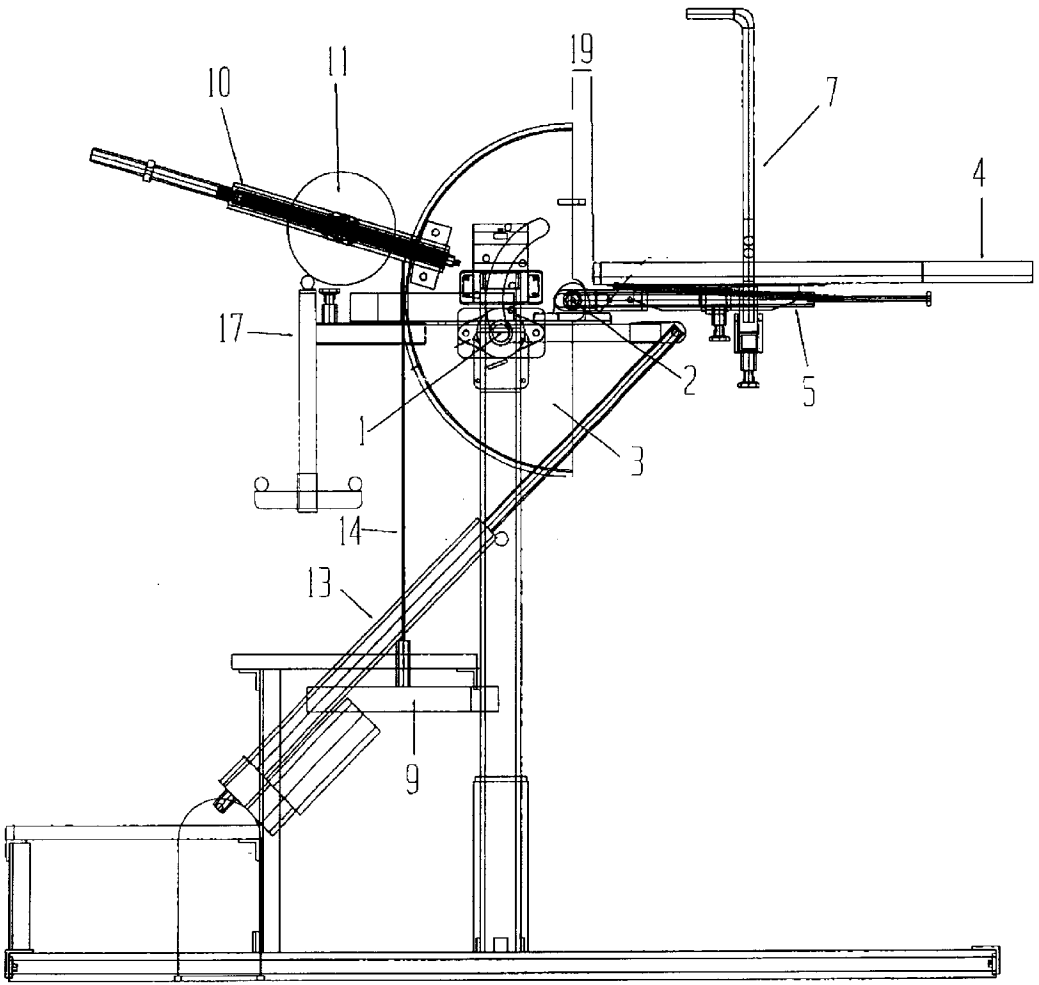
FIG. 5 is as FIG. 4, but with fully extended back rest.
Figure 6:
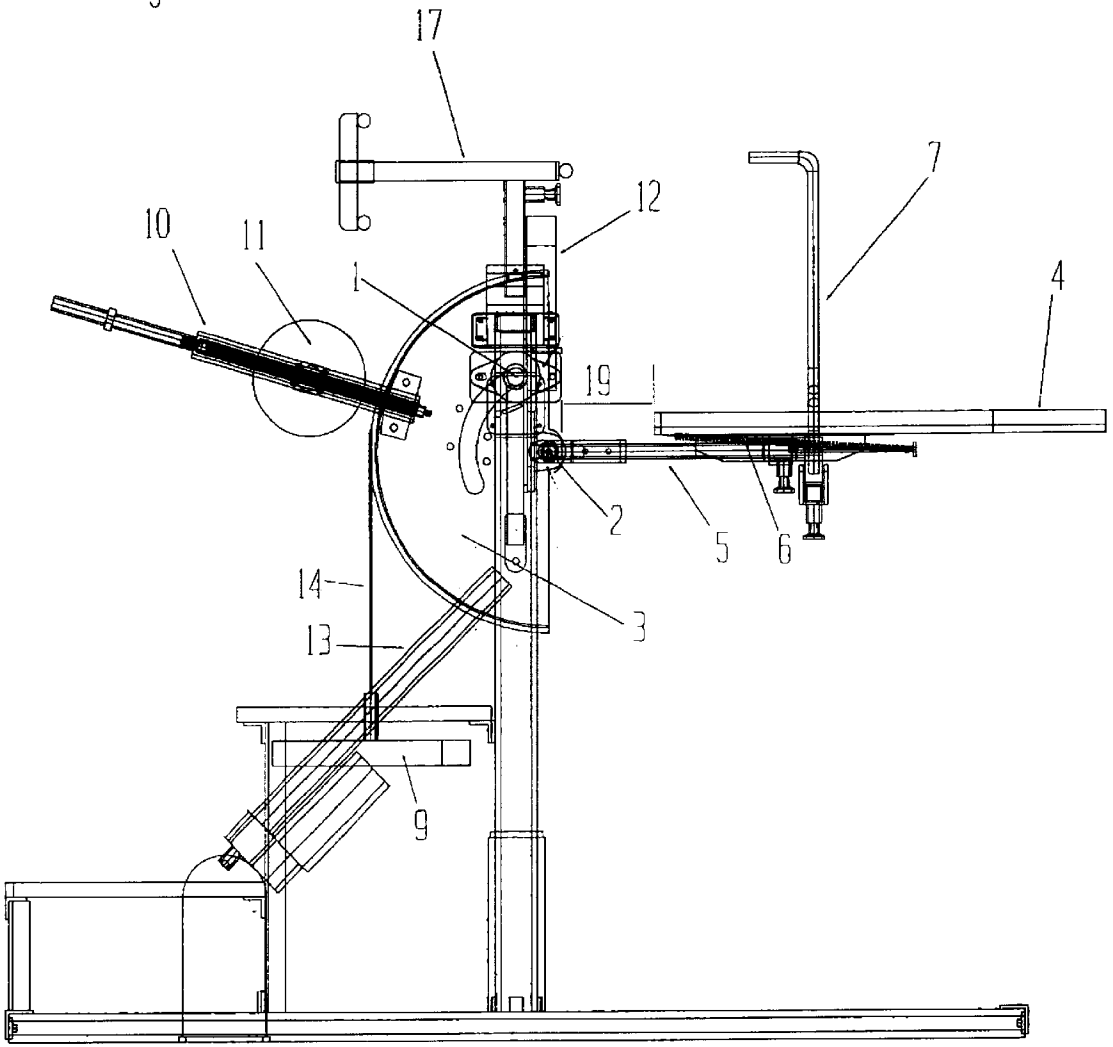
FIG. 6 is a cad drawing of the left side elevation at start position −90 degrees inversion.
Figure 7:
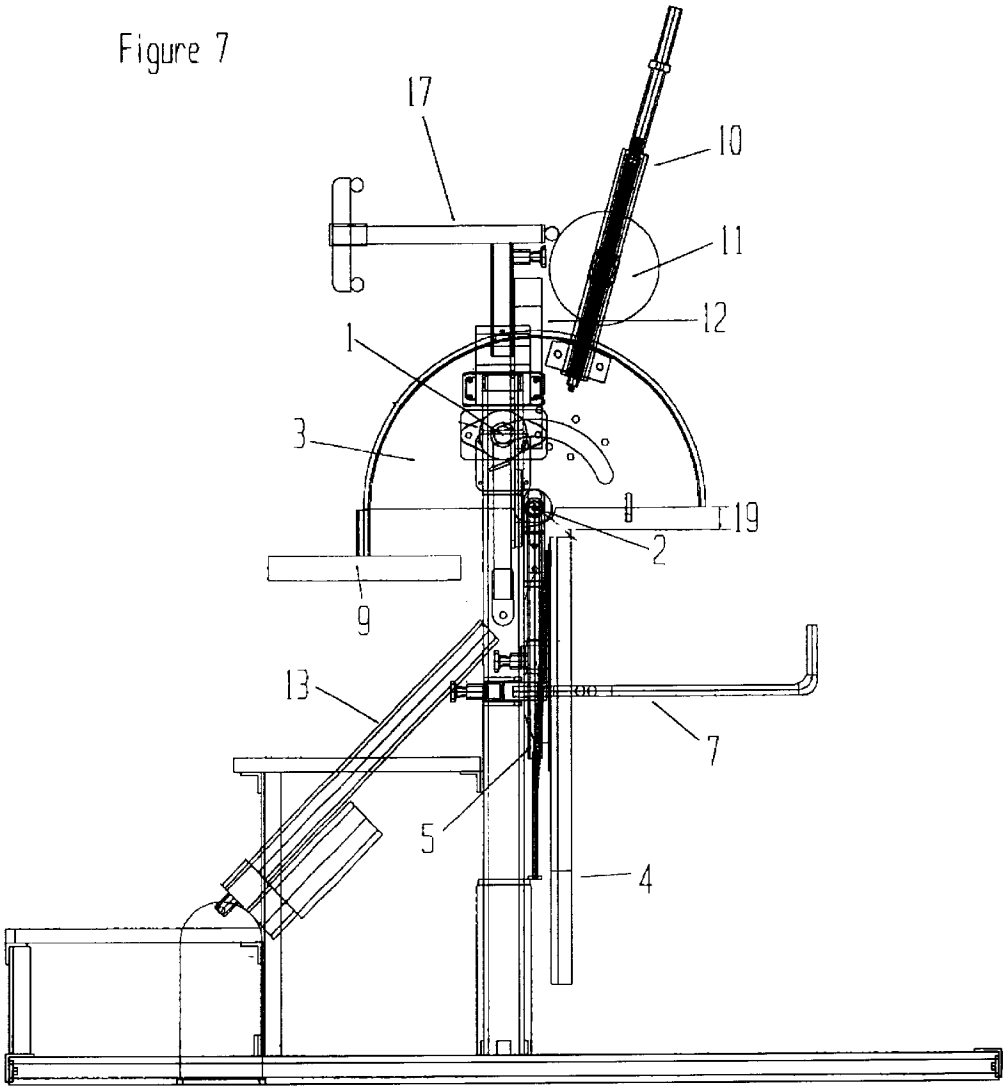
Figure 8:
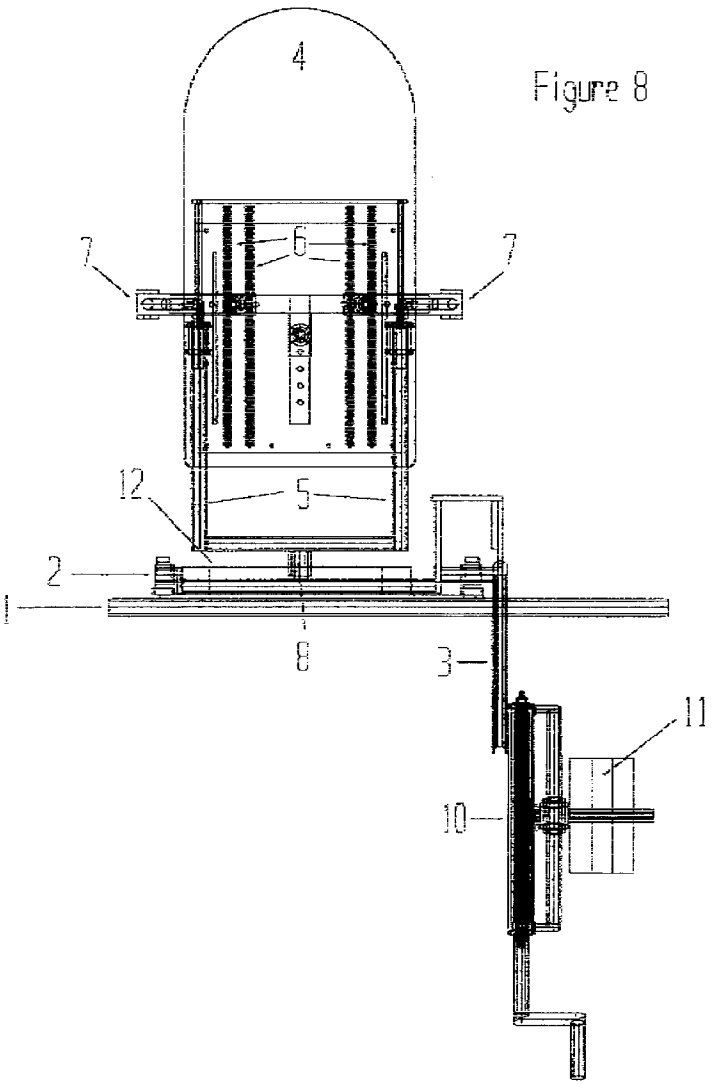
FIG. 8 is a cad drawing of the rear view elevation of the back rest assembly depicting suspension springs, parallel suspension tracks, torso pivot vertical axis, and both horizontal axis pivot shafts.

In FIG. 3, the user sits on the seat 12, with the leg hold 17 under the knees and the back against the back rest 4. The user's armpits are wrapped around the traction arms 7. For abdominal exercise, the plate stack 9 is disconnected at either end of the weight cable 14. If minimal traction is desired, so that gravity is not a factor, the horizontal axis pivot shaft 1 is left as in FIG. 3 and FIG. 4, with no inversion. The user extends the back against the back rest 4 until said back rest is parallel to the floor, as depicted in FIG. 5. While in that position, the counterbalance 10 is turned by rotating a threaded rod by handle or electronically so that the counterweight 11 is at the desired distance from the backrest horizontal axis pivot 2 which acts as a hinge of the backrest 4, giving the desired balance or negative balance to the user's upper body mass. The closer the counter weight 11 is to the horizontal axis pivot 2, the more negative balance exists, causing a stronger abdominal contraction to return the back rest 4 to the upright starting position, as in FIGS. 3 and 4. If the oblique muscles are to be involved in the exercise, the user twists at the hips causing the backrest 4 to pivot on the torso vertical axis pivot 8 FIG. 3. Traction in the zero degrees of inversion depicted in back rest 4 position in FIG. 5, is achieved by the pressure of the traction arm 7 lifting under the armpits of the user pulled by the elongation 19 of the traction springs 6 acting on the backrest 4 as it is pulled by the user via the traction arms 7 down the two parallel suspension shafts 5 during extension of the backrest 4. If more traction needed to the spine of the user, the actuator 13 is retracted by a switch 18 so that the horizontal axis pivot shaft 1 is rotated rearward to the desired angle, or maximum angle of minus 90 degrees depicted with the position in FIG. 6. All abdominal and back exercise is performed the same way, the difference being that for back exercise, the resistance weight is connected by attaching the plate stack 9 to the cam 3 by either end of the weight cable 14, and usually the patient or user is counter balanced neutral, by setting the counterweight 11 to the distance from the backrest hinge horizontal axis pivot 2 that creates a balance of the backrest 4 mass and its assembly added to the user's upper body mass, so that while in position of back extension, that being backrest 4 in positions depicted in FIG. 2 and FIG. 5, neither abdominal effort or back effort is noticeable by the user to either remain static in that position or to contract and extend the trunk. This is done before attaching the plate stack 9 for back resistance exercise. The torso pivot vertical axis 8 can be utilized for the external oblique muscles during back exercise as described for abdominal exercise.

What is claimed is:

1. An exercise device for rehabilitating atrophied spinal support muscle through progressive resistance exercise while the spine is placed in traction to enable the exercise, said device comprising:

a seat and back rest assembly, said back rest being exercise resistance loaded for both traction and extension resistance or flexion resistance, said backrest being further slideable on a track affixed to a horizontal axis pivot at the bottom of the back rest assembly, said back rest defined by a first resistance biasing the back rest away from said horizontal axis pivot, said pivot rotates against the action of said exercise resistance at zero, said first resistance for tractioning the spine simultaneously applying resistance as said exercise resistance adjusts positively for back resistance or negatively for abdominal resistance from an infinite angle between 0 and −90 degrees for loading the extensor muscles of the back or for the flexor muscles of the abdomen of the human trunk while the human trunk is static or in motion against the exercise resistance, a pair of armpit attachments wrapped around the user's arms for transmitting said progressive first resistance in tractioning the spine.

a weight plate stack attached to a cam, an adjustable counter weight for offsetting the user's upper body mass with respect to the upper body angle and gravitational effects, said counter weight rotatable by a threaded rod or handle, a weight cable attached to said cam for lifting said plate stack, a pair of leg holds for securing the legs, a counterbalance, traction springs, two parallel suspension shafts, an actuator, a switch, a horizontal axis pivot shaft, and a pair of bearings.

* * * * *